US006776964B1

(12) United States Patent
Wijnschenk et al.

(10) Patent No.: US 6,776,964 B1
(45) Date of Patent: Aug. 17, 2004

(54) SEALING MAT FOR CLOSING REACTION TUBES

(75) Inventors: Ronald Josephus Clemens Wijnschenk, Dronten (NL); Bartholomeus Wilhelmus Kramer, Lelystad (NL); Cornelis Johannes Verton, Lelystad (NL)

(73) Assignee: Micronic B.V., Lelystad (NL)

( * ) Notice: Subject to any disclaimer, the term of this patent is extended or adjusted under 35 U.S.C. 154(b) by 258 days.

(21) Appl. No.: 09/831,260

(22) PCT Filed: Sep. 7, 2000

(86) PCT No.: PCT/NL00/00631

§ 371 (c)(1),
(2), (4) Date: May 8, 2001

(87) PCT Pub. No.: WO01/17682

PCT Pub. Date: Mar. 15, 2001

(30) Foreign Application Priority Data

Sep. 8, 1999 (NL) ..... 1012996

(51) Int. Cl.[7] ..... B01L 3/00
(52) U.S. Cl. ..... 422/99; 422/102; 422/104
(58) Field of Search ..... 422/99, 102, 104; 435/283.1, 287.8, 287.9, 288.2, 288.3, 288.4; 206/557, 558; 220/253, 255

(56) References Cited

U.S. PATENT DOCUMENTS 4,599,314 A * 7/1986 Shami ..... 435/287
4,960,219 A * 10/1990 Jordan et al. ..... 215/354
5,096,676 A * 3/1992 McPherson et al. ..... 422/245
5,721,136 A * 2/1998 Finney et al. ..... 435/287.2
6,074,614 A 6/2000 Hafeman et al.
6,106,783 A * 8/2000 Gamble ..... 422/102
6,136,273 A * 10/2000 Seguin et al. ..... 422/99
6,432,694 B1 * 8/2002 Malmqvist ..... 435/286.5
6,518,060 B2 * 2/2003 Heimberg et al. ..... 435/305.3
6,558,628 B1 * 5/2003 Reo ..... 422/99
2001/0007642 A1 * 7/2001 Feiglin ..... 422/102

FOREIGN PATENT DOCUMENTS

EP 0 810030 A1 12/1997
EP 0 290 019 A2 11/1998

* cited by examiner

*Primary Examiner*—Jill Warden
*Assistant Examiner*—Dwayne K Handy
(74) *Attorney, Agent, or Firm*—Bachman & LaPointe, P.C.

(57) ABSTRACT

The invention relates to a sealing mat comprising a carrier sheet provided with a multiplicity of sealing elements for sealing test tubes. The carrier sheet, on the one hand, and the sealing elements, on the other hand, are made from different materials. The sealing elements can be made from a flexible and/or resilient material. The carrier sheet can be made from a material that is relatively stiff compared with the material of the sealing elements. The sealing elements can be detachably fixed to the carrier sheet. The sealing elements can be fixed to the carrier sheet such that they detach therefrom when the carrier sheet is pulled away while folding it over towards the rear, after sealing one or more test tubes.

25 Claims, 3 Drawing Sheets

SEALING MAT FOR CLOSING REACTION TUBES

The invention relates to a sealing mat for sealing test tubes, in particular to a sealing mat comprising a carrier sheet provided with a multiplicity of sealing elements for sealing test tubes.

A sealing mat of this type is known in practice. In this known sealing mat the carrier sheet and the sealing elements are made as an integral whole from one material and permanently joined to one another. Such sealing mats are used in particular with storage and reagent means, such as test tubes (also termed microtubes), microtitration plates and "Deepwell" blocks (these are test tubes permanently joined to one another). In this case the test tubes are in general grouped in a cluster in accordance with an 8×12 matrix pattern. A major advantage of such mats is that it is possible by this means as it were to open and to seal a large number of test tubes at the same time in a single operation. One disadvantage of the known sealing mat, amongst others, is that opening the test tubes is not always equally easy. The sealing elements sometimes have the tendency to remain firmly seated in the test tubes, in which case a substantial force then has to be exerted on the mat in order to remove the mat, under the influence of which force the mat has the tendency to stretch and also to lift the tube concerned, and also other tubes, out of the rack. Another disadvantage is that soiling or contamination can occur in other test tubes when the sealing mat is removed. A further major disadvantage is that all test tubes have to be opened in order to gain access to one test tube. A further disadvantage is that tools must be used if an individual (single) sealing element has to be fitted.

Within the scope of the invention a test tube is to be understood to be a container for storing substances, either in liquid form, powder form, solid form or in combinations thereof, for the purposes of chemical analyses, sample storage, performing chemical reactions in the test tube, etc. Such test tubes can have sizes ranging from small test tubes, such as so-called "microtubes" with a capacity of the order of 0.2 ml (or possibly less), to large test tubes having a capacity of 10 ml or more. Within the scope of the invention a test tube must also be understood to be composite storage and reagent means, such as microtitration plates and Deepwell blocks.

U.S. Pat. No. 5,282,543 discloses a sealing mat for sealing test tubes placed in a matrix pattern. According to a second embodiment of U.S. Pat. No. 5,282,543, the sealing mat consists of a sheet-like body that joins together a number of nodules which act as sealing elements and are arranged in a matrix pattern corresponding to the test tubes. The sheet-like body is provided with passages diagonally between every two adjacent nodules in order to guarantee adequate circulation of air for the purposes of heat transfer from a contact block to the underside of the sheet-like body. The entire teaching of U.S. Pat. No. 5,282,543 is directed towards the nodules being permanently attached to the sheet-like body.

EP-A 0 836 884 discloses a sealing system consisting of so-called inner sealing means and outer sealing means. The inner sealing means consist of cylindrical components which are to be placed within the open top end of a test tube and are sealed at their tops by a flat plate-like component having therein an optionally open, pre-formed passage for the point of a pipette. A number of inner sealing means are joined to one another by joining strips to give a matrix-like pattern. In this case there is no question of a carrier sheet and EP-A 0 863 884 also does not teach that the inner sealing means can be separated from one another. For sealing, in particular, the passages in the inner sealing means EP-A 0 836 884 provides outer sealing means in the form of a large sheet that is placed over the test tubes provided with inner sealing means and is pressed down onto these to produce a seal. However, this large sheet is not a carrier sheet for the cylindrical components of the inner sealing means.

The aim of the present invention is to provide an improved sealing mat for sealing test tubes.

This aim is achieved according to the invention in that the carrier sheet, on the one hand, and the sealing elements, on the other hand, are made of different materials, such as plastics. As a result of making the carrier sheet and the sealing elements for the sealing mat of different materials it becomes possible, inter alia, to use one material for the sealing elements, which, on the one hand, has very good sealing properties, and to use a material for the carrier sheet which, on the other hand, has properties which are favourable with respect to removing the sealing mat from the test tubes. These sealing properties on the one hand and removal properties on the other hand can then be mutually incompatible.

By making the carrier sheet and the sealing elements for the sealing must of different materials it becomes possible to assign another material to one of the elements, without the characteristics of the other material being affected. Examples are different colourings or different chemical resistance. However, making the carrier sheet, on the one hand, and the sealing elements, on the other hand, of different materials also offers yet further advantages. Since the sealing elements have to seal test tubes, special requirements are generally imposed on these in connection with chemical resistance.

So that the sealing elements have a good sealing action it is advantageous, according to the invention, if the sealing elements are made from a flexible and/or resilient material. This makes a close fitting seal of the sealing element on the test tube possible.

According to a particularly preferred embodiment of the sealing mat according to the invention it is highly advantageous if the sealing elements are attached to the carrier sheet such that they can be removed. In particular, this makes it possible to be able to open, independently of one another, the test tubes sealed by means of the sealing elements. After sealing the test tubes the carrier sheet can, for example, be removed, after which each of the test tubes is individually sealed and can also be moved individually in the sealed state.

According to a particular further embodiment of the invention it is advantageous if the sealing elements are attached to a carrier sheet in such a way that they detach from the carrier sheet when the latter is pulled back, while folding it over towards the rear, after sealing one or more test tubes. Pulling the carrier sheet back while folding it over towards the rear, that is to say pulling it back in a direction essentially transverse to the longitudinal direction of the test tubes, prevents a force acting in the longitudinal direction being exerted on the test tubes, which force could lift the test tubes from their container or rack. The sealing mat with which sealing elements are detachably attached to the carrier sheet has the additional advantage that said mat can be employed more easily in an automated process. According to a further embodiment guides are therefore also provided on opposing sides of the mat.

From the production engineering standpoint the join between the sealing elements and the carrier sheet can be produced simply and reliably if the sealing elements are provided with a peripheral groove in which the edge of the opening made in the carrier sheet is accommodated. With this arrangement the production procedure can be as follows:

A sheet having one opening per sealing element is first formed, for example by punching the desired number of openings in the desired positions in a sheet of suitable material. This sheet is then placed taut in an injection moulding mould, such that each opening is located at the position of the mould cavity for a sealing element. The edge of the opening in the carrier sheet will then project somewhat into the mould cavity in order to be incorporated or embedded in the sealing element on injecting the material for that sealing element. Depending on, inter alia, the materials used for the sealing elements and the carrier sheet, the injection moulding temperature and the duration of the injection moulding process, as well as on possible other factors, the sealing elements and the carrier sheet can then fuse with one another during this operation in order to form an integral whole or the edge of the carrier sheet can merely be accommodated in the peripheral groove without entering into a direct join with the sealing element other than by enclosure in the peripheral groove.

Other possible joins between the sealing elements and the carrier sheet are also conceivable, including clamping of the components on a mechanical basis or gluing in some other way. Permanent and completely loose joins can be produced by these means.

In order to make simple removal or detachment of the carrier sheet possible by pulling the latter away by folding over towards the rear in the case where the sealing elements have been detachably fixed to the carrier sheet, it is advantageous according to the invention if the peripheral groove is formed just below the top end of the sealing element. In this context "just below" is understood to be such that the sealing element is still able to overlap the carrier sheet at the top. With this arrangement the distance from the top of the groove to the top of the sealing element will in general be of the same order of magnitude as the thickness of the carrier sheet, for example 0.25 to 4 times the thickness of said carrier sheet. It is possible, for example, to make the distance from the top of the peripheral groove to the top of the sealing element equal to the thickness of the carrier sheet. If a 0.3 mm thick film is used for the carrier sheet this distance will then be 0.3 mm, or "just below" in this example must be taken to read 0.3 mm below the top end. Especially in the case where the sealing elements are detachably fixed to the carrier sheet and preferably are not fused to the latter, this provision of the peripheral groove just below the top end of the sealing element offers the advantage that the sealing element can be pulled away from the carrier sheet relatively easily in the downward direction relative to the carrier sheet. The small overlapping thickness of the sealing element, which is of the order of magnitude of the thickness of the carrier sheet, will then easily be able to give in order to be able to pull the sealing element from the carrier sheet. Although not absolutely necessary, it will be clear that this "detachability" functions particularly well if the sealing elements have been made from a relatively flexible material, it being possible for the carrier sheet then to have been made from a relatively rigid, or optionally even also flexible, material.

In order to counteract the carrier sheet accidentally being able to detach from the sealing element in the downward direction over said sealing element (if, for example, the sealing element is restrained and downward force is exerted on the carrier sheet), it is advantageous if the bottom face of the peripheral groove is continued further in the outward direction than is the top face of the peripheral groove. The sealing element thus provides a larger support surface for the carrier sheet in the downward direction, whilst said carrier sheet can still be detached from the sealing element in the upward direction.

The sealing elements can be of solid construction, but according to the invention it is advantageous if the sealing elements are caps, in particular caps which are hollow on the inside and open at the top, which are suitable for accommodating in the open end of the test tubes with an open end facing up. In this way the sealing element is more suitable for puncturing with a needle in order to gain access to the contents of the test tube. Because use is made of a carrier sheet containing holes, the needle will not have to puncture this carrier sheet, which also brings various advantages.

The material to be used can be of diverse nature. The following aspects in particular can be taken into account.

In order to counteract the contents of a test tube being able to enter into a reaction with a sealing element it is advantageous according to the invention if the sealing elements are made from a chemically resistant material.

According to the invention, sealing elements which have good closing and sealing characteristics as well as chemical resistance are obtained if the sealing elements are made from a TPE (thermoplastic elastomer) or PP (polypropene).

According to the invention it is particularly advantageous if the sealing elements are constructed such that they can be punctured by a needle, preferably relatively easily.

According to the invention the carrier sheet can advantageously be made from a PET (polyethene terephthalate) or PP (polypropene) material.

The present invention will be explained in more detail below with reference to illustrative embodiments shown in the drawing. In the drawing.

Figure 1:
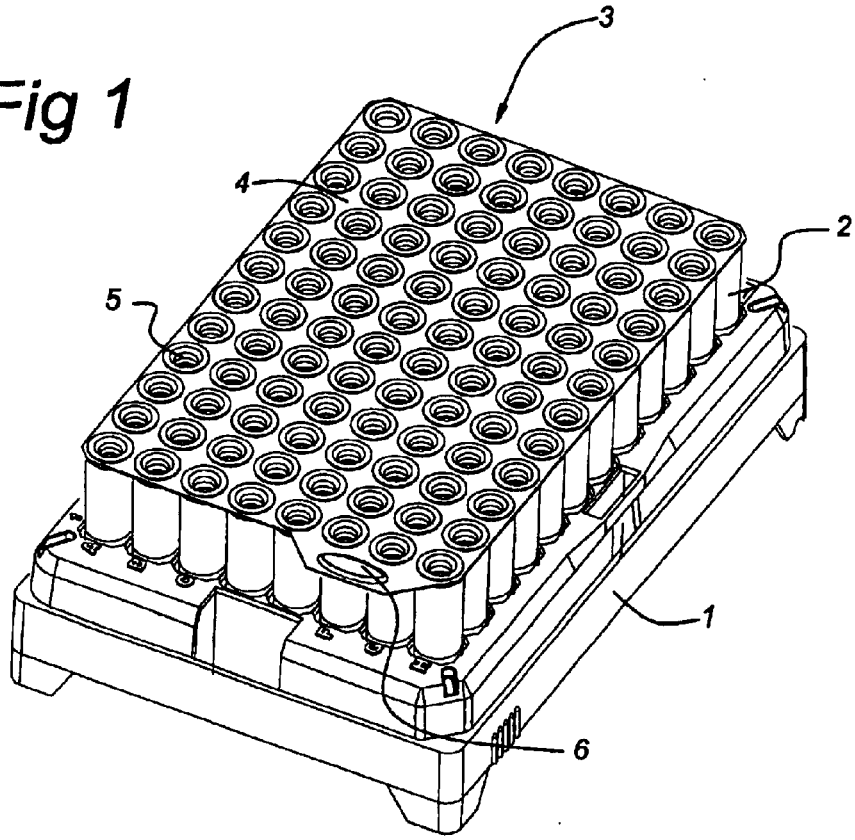
FIG. 1 shows a diagrammatic, perspective view of a container containing ninety-six test tubes on which a sealing mat according to the invention has been placed.
Figure 2:
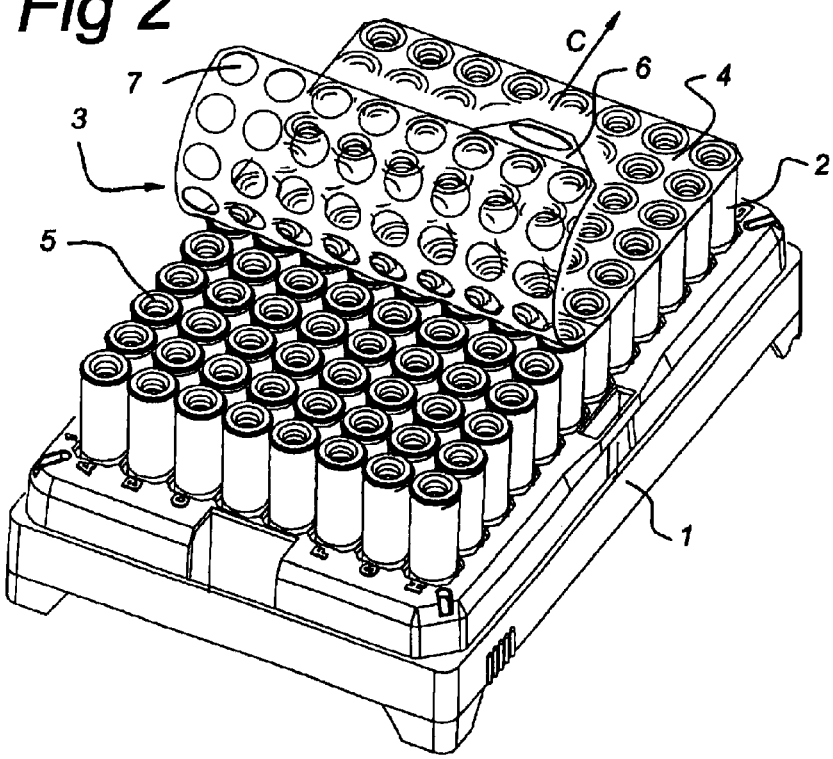
FIG. 2 shows a diagrammatic and perspective illustration of a sealing mat according to a first embodiment of the invention.
Figure 3:
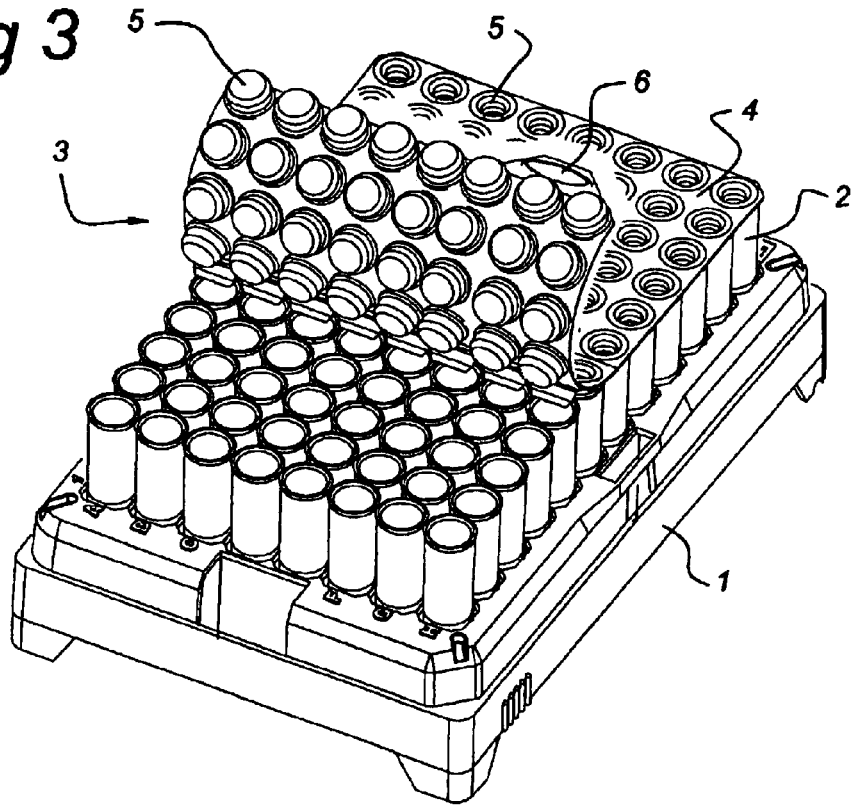
FIG. 3 shows a diagrammatic and perspective view of an illustration of a sealing mat according to a second embodiment of the invention.
Figure 4:
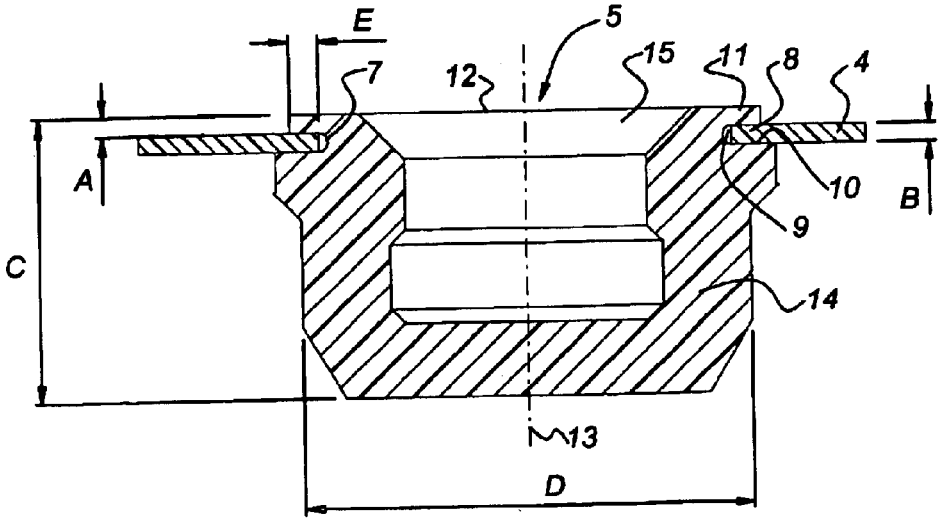
FIG. 4 shows a diagrammatic sectional view of a detail of a sealing mat according to the invention, in particular a portion of the sealing mat at the location of a sealing element.

Before discussing the figures in more detail it is pointed out that what is shown in FIGS. 1 and 4 must be seen both in relation to the first embodiment according to FIG. 2 and in relation to the second embodiment according to FIG. 3. The sealing mat shown in its entirety in FIG. 1 and by means of a detail in FIG. 4 can thus, as far as what is visible immediately from the figures is concerned, relate both to the sealing mat according to FIG. 2 and the sealing mat according to FIG. 3. The reason is that the difference between the embodiment according to FIG. 2 and the embodiment according to FIG. 3 essentially results from the material used for the carrier sheet.

FIG. 1 shows a container or rack 1 in which ninety-six test tubes 2, or, more accurately, so-called "microtubes" 2, have been placed in an 8×12 matrix pattern. The openings of these microtubes 2 are at the top and essentially in a flat plane. A sealing mat 3 consisting of a carrier sheet 4 with ninety-six cap-shaped sealing elements 5 has been placed on top of the microtubes 2. Each cap-shaped sealing element 5 has been pressed as a stopper into the open top of a microtube 2 in order that its side face 14 (FIG. 4) comes into contact with the inside wall of the microtube to provide a closure and a seal. The sealing mat 3 is further provided with a lip 6 that can serve as a grasping point for removal of the mat 3 or at least the carrier sheet 4.

If the carrier sheet 4 and the sealing caps 5 in the embodiment shown in FIG. 3 were to be made as an integral whole from one and the same material, the sealing mat 3 could then be regarded as a sealing mat according to the prior art known in practice.

However, according to the invention in the embodiment according to FIG. 3 the sealing elements 5 and the carrier sheet 4 are made from different materials, which different materials will have properties which differ from one another. Thus, "different materials" must also be understood as, for example, two PP materials which have different compositions and/or properties. In the case of the example shown in FIG. 3 the sheet and the sealing elements can both have been made from a PP material, but using a PP for the sheet that differs from that used for the sealing elements.

However, an advantageous embodiment is found to be sealing elements made of a TPE on a PP carrier mat.

As a result of using different materials for the sealing elements 5 and the carrier sheet 4, in accordance with the invention, it becomes possible, for example, to use a material for the sealing elements 5 that has very good properties with regard to sealing against the (inside) wall of the test tubes 2 and/or the chemical resistance and to make the carrier sheet 4 from a material that has very good properties in particular with regard to the removal of the sealing mat or at least the carrier sheet and optionally also fitting of the sealing mat, which good properties of a material for the carrier sheet and a material for the sealing elements can be completely incompatible with one another. Thus, it becomes possible to obtain a sealing mat that in respect of, inter alia, sealing, removal and fitting is appreciably better than that disclosed in the prior art.

With reference to FIG. 4, which is shown on a larger scale, the sealing mat 3 according to the invention can be produced by taking a carrier sheet 4, for example a film having a thickness of less than 0.5 mm, as the starting point, punching a matrix of 8×12 openings in this carrier sheet 4 and then clamping this carrier sheet 4 between two mould halves of an injection moulding in such a way that the edge portions 8 around the openings 7 project into the mould cavities of the mould halves and are embedded in a groove 9, to be formed around said edge portions 8, when injection moulding the material for the sealing element 5. Enclosure of the edge portions 8 between a lower limiting surface 10 and an upper limiting surface 11 of the groove 9 is achieved in this way. Depending on the conditions during the injection moulding process and/or the materials used for the carrier sheet 4 and the sealing elements 5 and/or other conditions, fusion of carrier sheet material and sealing element material may or may not then take place in the groove 9. If, for example, the sealing elements are made from a TPE and the carrier sheet 4 from a PP film fusion will in general then occur, whilst if the sealing elements are made from a TPE film and the carrier sheet from a PET film in general no mutual fusion but merely an enclosure or clamping will then take place.

If fusion takes place between the carrier sheet material and the sealing element material, the sealing elements will in general not be detachable, or at least not easily detachable, from the carrier sheet. This embodiment is shown in FIG. 3. As is shown diagrammatically in this figure, the sealing elements 5 will then all be removed from the test tubes or microtubes 2 more or less at the same time, at least in one operation, when a pull is exerted on the lip 7.

If no fusion takes place between the carrier sheet material 4 and the sealing element material 5 or only low strength fusion takes place between them, the sealing elements 5 can then be detached from the carrier sheet 4, which has the advantage that test tubes can then be left behind which can all be handled individually in the sealed state. Such an embodiment is shown in FIG. 2, in which, after detaching a portion of the carrier sheet 4, the openings 7 in which sealing elements 5 were seated are clearly visible. In the embodiment according to FIG. 2 the carrier sheet can have been made from a PET and the sealing elements can have been made from a TPE.

Again with reference to FIG. 4, it can be seen that the carrier sheet 4 is accommodated a distance A just below the top 12 of the sealing element 5 in a peripheral groove 9 that extends in the peripheral direction about the axis 13 around the entire periphery of the sealing element 5 and that this distance A is of the same order of magnitude as the thickness B of the carrier sheet 4. It can also be seen that the lower limiting surface 10 of the groove 9 extends further outwards with respect to the axis 13 than does the upper limiting surface 11 of the groove 9. In this way a support surface for the carrier sheet 4 in the downward direction is provided which is relatively larger than the support surface in the upward direction. This larger support surface 10 is particularly advantageous if the sealing elements 5 are removable from the carrier sheet 4. Specifically, in this way it is possible to counteract the carrier sheet 4 coming out of the groove 9 in the downward direction as a result of pressing on the carrier sheet 4 or on an adjacent sealing element 5, which in such a case could be unintentional and could occur when pressing an adjacent or neighbouring sealing element 5, or at least to make this more difficult. The overlap with the carrier sheet 4 is relatively small at the upper limiting surface 11 compared with the overlap with the lower limiting surface 10, which facilitates removal of the sealing element 5 from the carrier sheet 4, certainly if the sealing element 5 has been made from a relatively flexible, compliant material that is particularly very suitable for the sealing action in a test tube. This construction makes it possible in particular, as is shown diagrammatically in FIG. 2, to pull the carrier sheet 4 back and away in the manner termed "folding over towards to the rear" in the direction of arrow C more or less parallel to the plane in which the openings of the test tubes 2 are located. This pulling back and away will be easy to carry out especially in the case of a relatively rigid carrier sheet 4, leaving the sealing elements 5 behind in the test tubes 2.

With reference to FIG. 4 it is also pointed out that the essentially vertical flat portion 14 is the portion that essentially will provide the closing and seal at the inside wall of the test tube. On the grounds of, on the one hand, considerations with regard to saving of material and, on the other hand, considerations of functionality, the sealing elements 5 are constructed as caps having an internal cavity 15 open at the top.

The following dimensions are given merely by way of indication of the dimensions which a sealing element of a sealing mat according to the invention could have, as far as the embodiment shown in FIG. 4 is concerned:

| | | |
|---|---|---|
| Diameter | D | is approximately 7.5 mm |
| Distance | A | is approximately 0.3 mm |
| Thickness | B | is approximately 0.3 mm |
| Height | H | is approximately 4.8 mm |
| Overlap | E | is approximately 0.3 mm. |

It will be clear that these dimensions will relate to microtubes having an opening diameter of approximately 7.5 mm. However, it will also be clear that these dimensions are merely indicative and that the sealing elements and the carrier sheet can also have other dimensions, which can be either larger or smaller dimensions, depending on the application.

Figure 5:
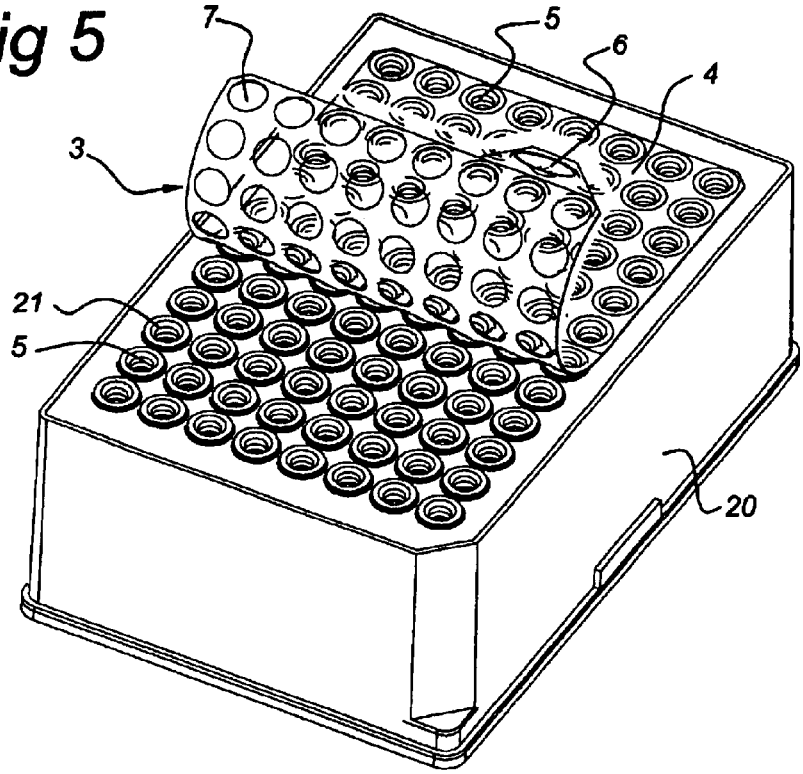
FIG. 5 shows a diagrammatic and perspective view of an illustration of a sealing mat according to the invention used with a so-called "Deepwell" block.

FIG. 5 shows a sealing mat according to FIG. 2 used with a "Deepwell" block, that is to say the sealing mat of the type with which the sealing elements 5 are detachable from the carrier sheet 4. This "Deepwell" block that is indicated by 20 is, as it were, a block containing integral test tubes 21 (which thus cannot be removed from the block). However, it will be clear that the sealing mat according to FIG. 3, that is to say the sealing mat of the type with which the sealing elements 5 are permanently joined to the carrier sheet 4, can also be used with a "Deepwell" block.

Figure 6:
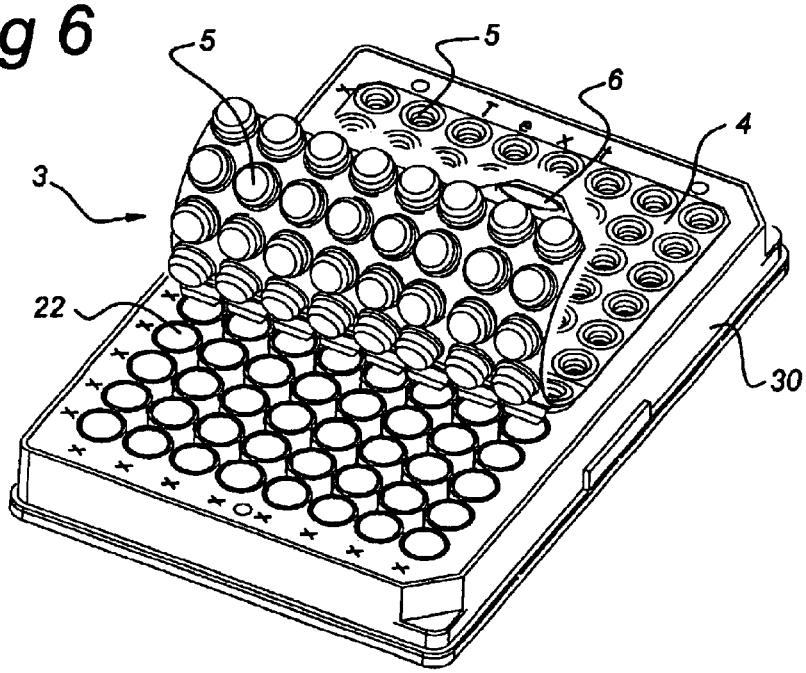
FIG. 6 shows a diagrammatic and perspective view of an illustration of a sealing mat according to the invention used with a so-called microtitration plate.

FIG. 6 shows a sealing mat according to FIG. 3, that is to say the sealing mat of the type with which the sealing elements 5 are permanently joined to the carrier sheet 4, used with a "microtitration plate". The microtitration plate, which is indicated by 20, is, as it were, a plate containing integral shallow test tubes 22 (which thus cannot be removed from the plate). However, it will be clear that the sealing mat according to FIG. 2, that is to say the sealing mat of the type with which the sealing elements 5 are detachable from the carrier sheet 4, can also be used with a microtitration plate.

What is claimed is:

1. Sealing mat comprising a carrier sheet provided with a multiplicity of sealing elements for sealing test tubes, characterised in that the carrier sheet, on the one hand, and the sealing elements, on the other hand, are made of different materials, and wherein the sealing elements have a peripheral groove, the carrier sheet has openings for receiving the sealing elements, and an edge of an opening made in the carrier sheet is accommodated in the peripheral groove.

2. Sealing mat according to claim 1, characterised in that the sealing elements are made from a flexible and/or resilient material.

3. Sealing mat according to claim 1, characterised in that the sealing elements are detachably fixed to the carrier sheet.

4. Sealing mat according to claim 1, characterised in that the sealing elements are attached to the carrier sheet in such a way that they detach from the carrier sheet when the latter is pulled away, while folding it over towards the rear, after sealing one or more test tubes.

5. Sealing mat according to claim 1, characterised in that the peripheral groove has been made just below the top end of the sealing element.

6. Sealing mat according to claim 1, characterised in that the bottom face of the peripheral groove has been continued further in the outward direction than has the top face of the peripheral groove.

7. Sealing mat according to claim 1, characterised in that the sealing elements are caps for fitting in the open end of the test tubes.

8. Sealing mat according to claim 1, characterised in that the sealing elements are made of a chemically resistant material.

9. Sealing mat according to claim 1, characterised in that the sealing elements are made from a TPE (thermoplastic elastomer), in particular a TPE that can be punctured by a needle.

10. Sealing mat according to claim 1, characterised in that the carrier sheet is made from a PET (polyethene terephthalate) or PP (polypropylene).

11. Sealing mat according to claim 1, characterised in that the sealing elements are arranged on the carrier sheet in accordance with a matrix pattern.

12. Sealing mat according to claim 1, wherein the matrix pattern is an 8×12 matrix pattern.

13. Sealing mat according to claim 1, wherein the peripheral groove is defined between an upper limiting surface and a lower limiting surface.

14. Sealing mat comprising a carrier sheet provided with a multiplicity of sealing elements for sealing test tubes, characterised in that the carrier sheet, on the one hand, and the sealing elements, on the other hand, are made of different materials, wherein the sealing elements have a peripheral groove, the carrier sheet has openings for receiving the sealing elements, an edge of an opening made in the carrier sheet is accommodated in the peripheral groove, and the sealing elements are detachably fixed to the carrier sheet.

15. Sealing mat according to claim 14, characterised in that the sealing elements are made from a flexible and/or resilient material.

16. Sealing mat according to claim 14, characterised in that the sealing elements are attached to the carrier sheet in such a way that they detach from the carrier sheet when the latter is pulled away, while folding it over towards the rear, after sealing one or more test tubes.

17. Sealing mat according to claim 14, characterised in that the peripheral groove has been made just below the top end of the sealing element.

18. Sealing mat according to claim 14, characterised in that the bottom face of the peripheral groove has been continued further in the outward direction than has the top face of the peripheral groove.

19. Sealing mat according to claim 14, characterised in that the sealing elements are caps for fitting in the open end of the test tubes.

20. Sealing mat according to claim 14, characterised in that the sealing elements are made of a chemically resistant material.

21. Sealing mat according to claim 14, characterised in that the sealing elements are made from a TPE (thermoplastic elastomer), in particular a TPE that can be punctured by a needle.

22. Sealing mat according to claim 14, characterised in that the carrier sheet is made from a PET (polyethene terephthalate) or PP (polypropylene).

23. Sealing mat according to claim 14, characterised in that the sealing elements are arranged on the carrier sheet in accordance with a matrix pattern.

24. Sealing mat according to claim 23, wherein the matrix pattern is an 8×12 matrix pattern.

25. Sealing mat according to claim 14, wherein the peripheral groove is defined between an upper limiting surface and a lower limiting surface.

* * * * *